United States Patent [19]

Wang et al.

[11] 4,192,739

[45] Mar. 11, 1980

[54] PROCESS FOR BENEFICIATION OF NON-SULFIDE ORES

[75] Inventors: Samuel S. Wang, Cheshire; Eugene L. Smith, Jr., Milford, both of Conn.

[73] Assignee: American Cyanamid Company, Stamford, Conn.

[21] Appl. No.: 862,994

[22] Filed: Dec. 21, 1977

[51] Int. Cl.[2] ..... B03D 1/02

[52] U.S. Cl. ..... 209/166

[58] Field of Search ..... 209/166, 167

[56] References Cited

U.S. PATENT DOCUMENTS

| | | | |
|---|---|---|---|
| 3,098,817 | 7/1963 | Baarson | 209/166 |
| 3,102,856 | 9/1963 | Chase | 209/166 |
| 3,779,380 | 12/1973 | Bishop | 209/166 |
| 3,915,391 | 12/1975 | Mercade | 209/166 |

FOREIGN PATENT DOCUMENTS

| | | | |
|---|---|---|---|
| 461394 | 11/1949 | Canada | 209/166 |
| 2312297 | 12/1976 | France | 209/166 |
| 2338324 | 12/1977 | France | 209/166 |
| 584206 | 11/1947 | United Kingdom | 209/166 |

OTHER PUBLICATIONS

Chem. Absts., vol. 79, 1973, 44567a.

Chem. Absts., vol. 74, 1971, 15109u.

*Primary Examiner*—Robert Halper

*Attorney, Agent, or Firm*—William J. van Loo

[57] ABSTRACT

Froth flotation of non-sulfide ores is improved in recovery when a collector combination of a fatty acid and a monoester of a sulfosuccinic acid or salt thereof is employed.

10 Claims, No Drawings

PROCESS FOR BENEFICIATION OF NON-SULFIDE ORES

CROSS-REFERENCE TO RELATED APPLICATION

This application is related to application Ser. No. 860,912 filed on even date herewith. This application relates to a froth flotation process for beneficiating non-sulfide ores using a collector combination of a fatty acid and a monoester of a sulfosuccinic acid or salt thereof. The related application relates to the combination of a fatty acid and a monoester of a sulfosuccinic acid or salt thereof.

This invention relates to an improved process for beneficiating non-sulfide ores. More particularly, this invention relates to such a process wherein a collector combination comprising a fatty acid and a monoester of sulfosuccinic acid or salts thereof.

Froth flotation is the principal means by which phosphate, barite, fluorite, hematite, taconite, magnetite and a host of other ores are concentrated. Its chief advantage lies in the fact that it is a relatively efficient process operating at substantially lower costs than many other processes.

Flotation is a process for separating finely ground valuable minerals from their associated gangue or waste or for separating valuable components one from another. In froth flotation, frothing occurs by introducing air into a pulp of finely divided ore and water containing a frothing agent. Minerals that have a special affinity for air bubbles rise to the surface in the froth and are separated from those wetted by the water. The particles to be separated by froth flotation must be of a size that can be readily levitated by the air bubbles.

Agents called collectors are used in conjunction with flotation to promote recovery of the desired material. The agents chosen must be capable of selectively coating the desired material in spite of the presence of many other mineral species. Current theory states that the flotation separation of one mineral species from another depends upon the relative wettability of surfaces. Typically, the surface free energy is purportedly lowered by the adsorption of heteropolar surface-active agents. The hydrophobic coating thus provided acts in this explanation as a bridge so that the particle may be attached to an air bubble. The practice of this invention is not limited, however, by this or other theories of flotation.

Phosphate rock is a typical example of a non-sulfide ore. Typically, phosphate ore containing about 15–35% BPL [bone phosphate of lime, $Ca_3(PO_4)_2$] is concentrated in very large tonnages from the Florida pebble phosphate deposits. The ore slurry from strip mining is sized at about 1 millimeter and the coarser fraction, after scrubbing to break up mud balls, is a finished product. The minus 1 mm fraction is further sized at 35 and 200 mesh. The minus 200 mesh slime is discarded. From the sizing operation the +35 mesh material in thick slurry is treated with fatty acid, fuel oil, and caustic, ammonia or other alkaline material and the resulting agglomerates are separated on shaking tables, spirals or spray belts. The 35×200 mesh fraction is conditioned with the same type of reagents and floated by conventional froth flotation routes. Not all the silica gangue is rejected by the fatty acid flotation, so the concentrate is blunged with acid to remove collector coatings, deslimed, washed free of reagents and subjected to an amine flotation with fuel oil at pH 7–8. This latter flotation, sometimes called "cleaning", removes additional silica and raises the final concentrate grade to 75–80% BPL.

Although the procedure described above is effective in the beneficiation of non-sulfide ores in general, there, nevertheless, exists the need for more effective collectors which provide increased recovery of non-sulfide minerals while still providing high grade. It is particularly desirable to reduce the requirements for fatty acids which are constantly being diverted to nutritional and other uses. In view of the high quantities of non-sulfide minerals processed by froth flotation, such a development can result in a substantial increase in the total amount of mineral values recovered and provide substantial economic advantages even when a modest increase in recovery is provided. It is also highly desirable to have an efficient collector system for use at reduced dosage levels without sacrificing the mineral recovery performance. The decreases in regent consumption are significant in view of the increasing diversion of fatty acids to nutritional and other uses. Accordingly, the provision for an improved process for froth flotation of non-sulfide minerals would fulfill a long-felt need and constitute a notable advance in the art.

In accordance with the present invention, there is provided a process for beneficiating non-sulfide ores which comprises classifying the ore to provide particles of flotation size, slurrying the classified ore in aqueous medium, conditioning the slurry with an effective amount of a collector combination and floating the desired mineral values, said collector combination comprising from about 1 to about 99 weight percent of a fatty acid and, correspondingly, from about 99 to about 1 weight percent of a monoester of a sulfosuccinic acid of the general formula

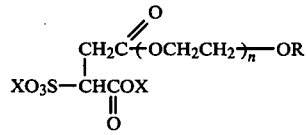

wherein R is an alkyl radical of about 4 to 18 carbon atoms, an aryl radical of one to two carbocyclic rings, an alkaryl radical of about 7 to 18 carbon atoms, or an aralkyl radical of 7 to 18 carbon atoms, n has a numerical value of about 0 to 12, and X is hydrogen, alkali metal or ammonium ion.

The process using the specified collector combination provides superior performance over either component alone and leads to high recovery and grade at low dosage requirements. In preferred instances, fatty acid requirements can be reduced by about 50% while still providing high mineral recovery and grade.

In carrying out the process of the present invention, a non-sulfide mineral is selected for treatment. Such minerals include phosphate, fluorite, barite, hematite, taconite, magnetite, fluorspar and the like that are conventionally processed by froth flotation using an acid collector. The selected mineral is screened to provide particles of flotation size according to conventional procedures. Generally, the flotation size will encompass from about 35 to 150 mesh size particles.

After the selected mineral has been sized as indicated, it is slurried in aqueous medium and conditioned with an effective amount of the collector combination. Generally, the effective amount will be found in the range of about 0.01 to 2.0 pounds per ton of ore although variations in the amounts will arise due to the specific ore being treated, the particular collector combination being used, the nature and amount of gangue material present, the particular values of recovery and grade desired, and the like. Non-sulfide minerals, in general, are floated at a pH value in the range of about 6.0 to 12.0, preferably about 8.0 to 10.0. Suitable additional additives such as pH regulators, frothers, fuel oil and the like may be added in conjunction with conventional procedures.

After the slurry has been conditioned as indicated, it is subjected to froth flotation following conventional practice. The desired mineral values are recovered with the froth and the gangue material remains behind.

The process of the present invention uses as the mineral collector a combination of from about 1 to about 99 weight percent of a fatty acid derived from a vegetable or animal oil and, correspondingly, from about 99 to about 1 weight percent of a monoester of a sulfosuccinic acid of the general formula

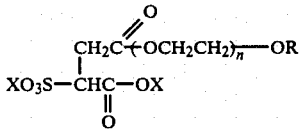

wherein R is an alkyl radical of about 4 to 18 carbon atoms, an aryl radical of one to two carbocyclic rings, an alkaryl radical of about 7 to 18 carbon atoms or an aralkyl radical of about 7 to 18 carbon atoms, n has a numerical value of about 0 to 15, and X is hydrogen, alkali metal or ammonium ion. Illustrative compounds of this structure include

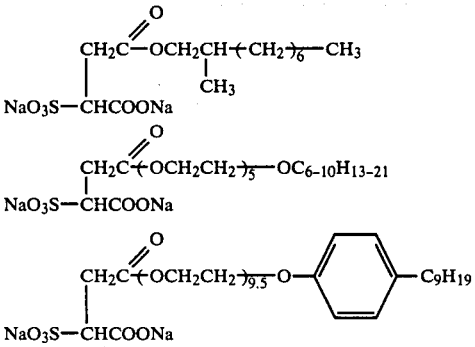

as well as the corresponding free acids, potassium salts and ammonium salts thereof.

The fatty acid employed in the collector combination is one derived from a vegetable or animal oil. Illustrative vegetable oils include babassu, castor, Chinese tallow, coconut, corn, cottonseed, grapeseed, hempseed, kapok, linseed, wild mustard, oiticica, olive, ouri-ouri, palm, palm kernel, peanut, perilla, poppyseed, Argentine rapeseed, rubberseed, safflower, sesame, soybean, sugarcane, sunflower, tall, teaseed, tung and ucuhuba oils. Animal oils include fish and livestock oils. These oils contain acids ranging from six to twenty-eight carbon atoms or more which may be saturated or unsaturated, hydroxylated or not, linear or cyclic and the like.

A preferred collector combination for use in the process of the present invention is one containing about 70 to 97 weight percent of fatty acid and, correspondingly, from about 30 to 3 weight percent of the monoester of sulfosuccinic acid or salt thereof.

The invention is more fully illustrated in the examples which follow wherein all parts and percentages are by weight unless otherwise specified. Although the invention is illustrated with phosphate rock as typical of non-sulfide ores, it is to be understood that similar benefits are obtainable with non-sulfide ores in general. The following general procedure is employed in the froth flotation examples which follow.

GENERAL PROCEDURE

Rougher Float

Step 1: Secure washed and sized feed, e.g., 35×150 mesh screen fractions. Typical feed is usually a mixture of 23% coarse with 77% fine flotation particles.

Step 2: Sufficient wet sample, usually 640 grams, to give a dry weight equivalent of 500 grams. The sample is washed once with about an equal amount of tap water. The water is carefully decanted to avoid loss of solids.

Step 3: The moist sample is conditioned for one minute with approximately 100 cc of water, sufficient caustic as 5–10% aqueous solution to obtain the pH desired (pH 9.5–9.6) a mixture of 50% acid and fuel oil and additional fuel oil as necessary. Additional water may be necessary to give the mixture the consistency of "oatmeal" (about 69% solids). The amount of caustic will vary from 4 to about 20 drops. This is adjusted with a pH meter for the correct endpoint. At the end of the conditioning, additional caustic may be added to adjust the endpoint. However, an additional 15 seconds of conditioning is required if additional caustic is added to adjust the pH. Five to about 200 drops of acid-oil mixture and one-half this amount of additional oil is used, depending on the treatment level desired.

Step 4: Conditioned pulp is placed in an 800-gram bowl of a flotation machine and approximately 2.6 liters of water are added (enough water to bring the pulp lever to lip of the container). The percent solids in the cell is then about 14%. The pulp is floated for 2 minutes with air introduced after 10 seconds of mixing. The excess water is carefully decanted from the rougher products. The tails are set aside for drying and analysis.

Step 5: The products are oven dried, weighed, and analyzed for weight percent $P_2O_5$ or BPL. Recovery of mineral values is calculated using the formula:

$$\frac{(W_c)(P_c)}{(W_c)(P_c) + (W_t)(P_t)} \times 100$$

wherein $W_c$ and $W_t$ are the dry weights of the concentrate and tailings, respectively, and $P_c$ and $P_t$ are the weight percent $P_2O_5$ or BPL of the concentrate or tails, respectively.

COMPARATIVE EXAMPLE A

Following the general procedure using Florida pebble phosphate, a series of froth flotations were run following conventional procedures. The flotations were run at pH 9.0 using varying dosages of a fatty acid derived from tall oil in conjunction with No. 5 fuel oil, the dosage of fuel oil being equal to the dosage of fatty acid. Results and test details are given in Table I which follows.

TABLE I

| PHOSPHATE ROCK FLOTATION WITH FATTY ACID | | | | | | | |
|---|---|---|---|---|---|---|---|
| | Dosages | | Weight | | | | BPL |
| | Fatty Acid | Fuel Oil | Recovery | BPL % | | | Recovery |
| Run | (lbs.ton) | (lbs.ton) | (%) | Feed | Tail | Concentrate | (%) |
| 1 | 0.34 | 0.34 | 8.94 | 19.86 | 15.14 | 67.98 | 30.60 |
| 2 | 0.37 | 0.37 | 11.05 | 18.23 | 11.83 | 69.77 | 42.29 |
| 3 | 0.40 | 0.40 | 12.77 | 18.15 | 10.65 | 69.36 | 48.81 |
| 4 | 0.44 | 0.44 | 13.65 | 18.64 | 10.93 | 67.45 | 49.38 |
| 5 | 0.47 | 0.47 | 15.19 | 18.95 | 10.71 | 64.94 | 52.06 |
| 6 | 0.50 | 0.50 | 15.10 | 17.73 | 8.47 | 69.77 | 59.43 |

EXAMPLE 1

The procedure of Comparative Example A was followed in every material detail except that in place of the fatty acid used therein there was used a combination of the same fatty acid and a monoester of sulfosuccinic acid of the structure:

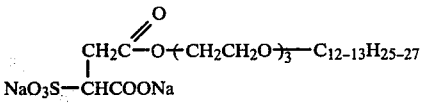

The sulfosuccinate was used as a replacement for varying proportions of the fatty acid and the total dosage was varied. In each instance the usage of No. 5 fuel oil was equal to the total dosage of the combination. Results and test details are given in Table II which follows.

TABLE II

| | Dosages | | | | Weight | | | | BPL | Improvement |
|---|---|---|---|---|---|---|---|---|---|---|
| | Fatty Acid | Surfactant | FA/S[1] | Fuel Oil | Recovery | % BPL | | | Recovery | Over Fatty |
| Run | (lbs/ton) | (lbs/ton) | Ratio | (lbs/ton) | (%) | Feed | Tail | Conc. | (%) | Acid Alone[2](%) |
| 1 | 0.258 | 0.082 | 74/26 | 0.34 | 16.23 | 18.47 | 8.47 | 70.07 | 61.58 | 101.0 |
| 2 | 0.300 | 0.070 | 81/19 | 0.37 | 16.21 | 17.95 | 7.79 | 70.49 | 63.64 | 50.5 |
| 3 | 0.368 | 0.032 | 92/8 | 0.40 | 17.39 | 18.24 | 7.01 | 71.56 | 68.24 | 39.8 |
| 4 | 0.422 | 0.018 | 96/4 | 0.44 | 19.06 | 18.54 | 6.17 | 71.09 | 73.07 | 48.0 |
| 5 | 0.451 | 0.019 | 96/4 | 0.47 | 19.69 | 20.08 | 7.57 | 71.09 | 69.72 | 33.9 |

Notes:
[1]Ratio of Fatty Acid to Surfactant, respectively.
[2]Based on equal total dosage results in Table I.

EXAMPLE 2

The general procedure was again followed using a fatty acid derived from tall oil in conjunction with No. 5 fuel oil. In one run for comparative purposes, run 4 of Comparative Example A was repeated. In this example, 92% of the fatty acid was used in combination with 8% of a surfactant of the formula:

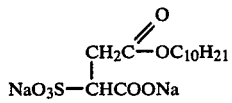

Results and test details are given in Table III which follows.

TABLE III

| FLOTATION WITH FATTY ACID AND COLLECTOR COMBINATION | | | | | | | | | |
|---|---|---|---|---|---|---|---|---|---|
| | Dosages | | | Weight | | | | BPL | Improvement |
| | Fatty Acid | Surfactant | Fuel Oil | Recovery | % BPL | | | Recovery | Over Fatty |
| Run | (lbs/ton) | (lb/ton) | (lbs/ton) | (%) | Feed | Tail | Conc. | (%) | Acid (%) |
| 4 of Comp. Ex. A | 0.44 | — | 0.44 | 13.65 | 18.64 | 10.93 | 67.45 | 49.38 | — |
| Example 2 | 0.405 | 0.035 | 0.44 | 14.32 | 18.70 | 10.19 | 69.95 | 53.31 | 8.0 |

EXAMPLE 3

The procedure of Example 2 was followed in every material detail except that the surfactant employed had the structure:

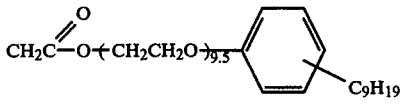

Results and test details are given in Table IV which follows:

TABLE IV

| FLOTATION WITH FATTY ACID AND COLLECTOR COMBINATION | | | | | | | | | |
|---|---|---|---|---|---|---|---|---|---|
| | Dosages | | | Weight | | | | BPL | Improvement |
| | Fatty Acid | Surfactant | Fuel Oil | Recovery | % BPL | | | Recovery | Over Fatty |
| Run | (lbs/ton) | (lbs/ton) | (lbs/ton) | (%) | Feed | Tail | Conc. | (%) | Acid (%) |
| 4 of Comp. Ex. A | 0.44 | — | 0.44 | 13.65 | 18.64 | 10.93 | 67.45 | 49.38 | — |
| Example 3 | 0.405 | 0.035 | 0.44 | 14.38 | 18.10 | 9.34 | 70.26 | 55.82 | 13.0 |

EXAMPLE 4

The procedure of Example 1 was again followed using crude tall oil and the same surfactant but using recycled motor oil at double the dosage of collector or combination. Details and results are given in Table V.

TABLE V

FLOTATION WITH COMBINATION COLLECTOR

| Run | Fatty Acid (lbs/ton | Surfactant (lbs/ton) | FA/S' Ratio | Recycled Motor Oil (lbs/ton | Weight Recovery (%) | % BPL Feed | % BPL Tail | % BPL Conc. | BPL Recovery (%) |
|---|---|---|---|---|---|---|---|---|---|
| 1 | 0.4 | — | 100/0 | 0.8 | 4.41 | 14.66 | 12.70 | 57.19 | 17.20 |
| 2 | 0.38 | 0.02 | 95/5 | 0.8 | 12.32 | 15.34 | 9.46 | 52.23 | 45.95 |
| 3 | 0.36 | 0.04 | 90/10 | 0.8 | 15.95 | 15.03 | 7.12 | 56.72 | 60.19 |
| 4 | 0.32 | 0.08 | 80/20 | 0.8 | 20.82 | 15.71 | 4.91 | 56.78 | 75.25 |
| 5 | 0.28 | 0.12 | 70/30 | 0.8 | 22.63 | 15.58 | 3.81 | 55.84 | 81.08 |
| 6 | 0.24 | 0.16 | 60/40 | 0.8 | 21.66 | 15.02 | 3.86 | 55.32 | 79.86 |
| 7 | 0.20 | 0.20 | 50/50 | 0.8 | 22.66 | 15.31 | 2.71 | 58.31 | 86.31 |
| 8 | 0.16 | 0.24 | 40/60 | 0.8 | 26.61 | 14.67 | 2.26 | 48.89 | 88.69 |
| 9 | 0.12 | 0.28 | 30/70 | 0.8 | 27.55 | 15.14 | 3.20 | 46.54 | 84.69 |
| 10 | 0.08 | 0.32 | 20/80 | 0.8 | 28.50 | 14.48 | 2.87 | 43.59 | 85.82 |
| 11 | 0.04 | 0.36 | 10/90 | 0.8 | 29.99 | 14.61 | 3.86 | 39.70 | 81.50 |
| 12 | 0 | 0.40 | 0/100 | 0.8 | 23.47 | 14.69 | 4.42 | 48.18 | 76.97 |

We claim:

1. A process for beneficiating non-sulfide ores selected from the group consisting of phosphate, fluorite, barite, hematite, taconite, magnetite and fluorspar which comprises classifying the ore to provide particles of flotation size, slurrying the classified ore in aqueous medium, conditioning the slurry with an effective amount of a collector combination and floating the desired mineral values, said collector combination comprising from about 1 to about 99 weight percent of a fatty acid derived from a vegetable or animal oil and, correspondingly, from about 99 to about 1 weight percent of a monoester of a sulfosuccinic acid of the general formula

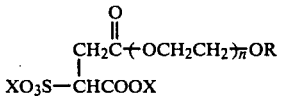

wherein R is an alkyl radical of about 4 to 18 carbon atoms an aryl radical of one to two carbocyclic rings, an alkaryl radical of about 7 to 18 carbon atoms, or an aralkyl radical of about 7 to 18 carbon atoms, n has a numerical value of about 1 to 12, and X is hydrogen, alkali metal or ammonium ion.

2. The process of claim 1 wherein said monoester of sulfosuccinic acid has the structure:

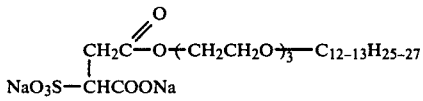

3. The process of claim 1 wherein said monoester of sulfosuccinic acid has the structure:

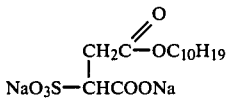

4. The process of claim 1 wherein said monoester of sulfosuccinic acid has the structure:

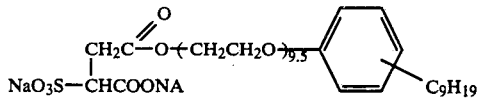

5. The process of claim 1 wherein said fatty acid is derived from tall oil.

6. The process of claim 1 wherein said collector combination comprises from about 70 to about 97 weight percent of said fatty acid and from about 30 to about 3 weight percent of said monoester of a sulfosuccinic acid.

7. The process of claim 1 wherein said collector combination comprises from about 74 to 96 weight percent of said fatty acid and from about 30 to 4 weight percent of a monoester of a sulfosuccinic acid.

8. The process of claim 1 wherein said fatty acid is derived from tall oil and said monoester of sulfosuccinic acid has the structure:

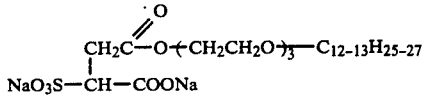

9. The process of claim 1 wherein said fatty acid is derived from tall oil and said monoester of sulfosuccinic acid has the structure:

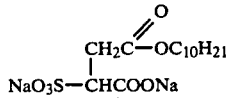

10. The process of claim 1 wherein said fatty acid is derived from tall oil and said monoester of sulfosuccinic acid has the structure:

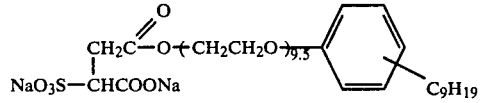

* * * * *